US005771574A

United States Patent [19]

Kato et al.

[11] Patent Number: 5,771,574

[45] Date of Patent: Jun. 30, 1998

[54] APPARATUS FOR MANUFACTURING PRESSURE-WELDED ELECTRICAL HARNESSES AND A METHOD THEREOF

[75] Inventors: Sanae Kato; Kazuhiko Takada, both of Shizuoka, Japan

[73] Assignee: Yazaki Corporation, Tokyo, Japan

[21] Appl. No.: 593,510

[22] Filed: Jan. 30, 1996

[30] Foreign Application Priority Data

Feb. 8, 1995 [JP] Japan ..... 7-20704

[51] Int. Cl.[6] ..... H01R 43/04

[52] U.S. Cl. ..... 29/861; 29/857; 29/753

[58] Field of Search ..... 29/749, 753, 857, 29/861; 228/180.1

[56] References Cited

U.S. PATENT DOCUMENTS

| | | | |
|---|---|---|---|
| 4,007,534 | 2/1977 | Tucci | 29/566.3 |
| 4,372,041 | 2/1983 | Winkelman | 29/753 |
| 4,419,817 | 12/1983 | Funcik et al. | 29/857 |
| 4,479,407 | 10/1984 | Mikami et al. | 29/753 |
| 4,616,396 | 10/1986 | Matsui | 29/857 |
| 4,682,391 | 7/1987 | Hall, Jr. et al. | 29/749 |
| 4,839,962 | 6/1989 | Long, Jr. | 29/749 |

FOREIGN PATENT DOCUMENTS 60-14780 1/1985 Japan .

*Primary Examiner*—Kenneth J. Ramsey
*Attorney, Agent, or Firm*—Armstrong, Westerman Hattori, McLeland & Naughton

[57] ABSTRACT

An apparatus for manufacturing electrical harnesses including wires and electrical connectors comprises a pair of wire measuring rollers, a pair of connector tables located respectively at a first and a second locations for setting connectors thereon, which first location being near the rollers and the second location being in the wire feeding direction away from the first location, a wire feeding head disposed near a first connector table located at the first location and axially movable between the first and second locations, and a vertically movable wire pressing blade disposed on the first connector table, wherein a second connector table on which a down-facing connector is set and a third connector table on which an up-facing connector is set can be replaced with each other at the second location.

In this structure, the second connector table is provided with a pectinate wire guide section having a plurality of slits, a wire pressing blade under the table to be inserted into the slits, and a pressing member for pressing the down-facing connector above the table in a vertically movable manner, whereas the third connector table is provided with a plurality of slits, and also a wire pressing blade above the table in a vertically movable manner.

10 Claims, 9 Drawing Sheets

APPARATUS FOR MANUFACTURING PRESSURE-WELDED ELECTRICAL HARNESSES AND A METHOD THEREOF

BACKGROUND OF THE INVENTION

1. Field of the Invention

The present invention relates to an apparatus and a method for manufacturing electrical harnesses including wires and electrical connectors, and more particularly to an apparatus capable of pressure welding the wires into an upwardly-facing connector at one end and into either an upwardly-facing or a downly-facing connector at the other end.

2. Description of the Prior Art

An example of a prior art apparatus for manufacturing electrical harnesses is shown in FIG. 8 as disclosed in Japanese Patent Application Laid-open No. 60-14780, wherein the apparatus 60 includes a wire guide 62 along a wire feed path for guiding a plurality of parallel electric wires 61, a chuck 63 for clamping the front end portions of the respective electric wires 61, a driving chain 64 capable of reciprocally shifting the chuck 63 in the forward and backward directions, a wire cutter 65 for cutting the plurality of electric wires 61, a punch 59 and a die 68 for pressing those electric wires into the terminals accommodated in a pressure welding type connector 66, and a press cylinder 69 for fixing the rear end portions of the respective electric wires 61.

It is to be noted that the pressure welding type connector includes an open-topped insulating housing in which a plurality of terminals are loaded so as to accommodate a plurality of insulation-coated wires, with each terminal including a slot in which the wire is pressed such that an insulating cover thereof is broken by the sides of the slot so as to allow electric connection between the wire and the terminal.

The front end portions of the wires 61, cut by the wire cutter 65, are pressed (or hereinafter it may be expressed as "pressure welded") into the first connector 66 by the punch 59 and the die 68, and the connector 66 is then shifted in the forward direction by the driving chain 64, so that a second pressure-welding type connector 67 is then connected to the intermediate portion of the wires 61. Thereafter, the driving chain 64 is shifted forwardly, so that the wires 61 are cut at the rear end area of the connector 67.

However, with the manufacturing apparatus 60 as constructed above, although the wires 61 can be attached to connectors $\mathbf{66}_1$ and $\mathbf{67}_1$ in series at the longitudinal ends thereof as shown in FIG. 9, it is not possible, as shown in FIGS. 10 and 11, to attach the wires 61 to an elongate connector $\mathbf{66}_2$ or $\mathbf{66}_3$ at one longitudinal end thereof and to a plurality of connectors $\mathbf{67}_2$ or $\mathbf{67}_3$ of different lengths at the other longitudinal ends thereof. Further, the wires 61 cannot be attached to the respective connectors 66 and 67 making a cross line therebetween.

In addition, the pressure-welded harnesses 70 to 72 in FIGS. 9 to 11 are so-called 1-N harnesses wherein the connectors 66 and 67 are both facing upwardly as shown in FIG. 12, so that a so-called 1—1 harness 73 in which one connector 66 is facing upwardly while the other connector 67 is facing downwardly as shown in FIG. 13 cannot possibly be formed. This 1—1 type harness 73 is for constructing a harness shown in FIG. 14, which is formed by bending the wires in the intermediate portions thereof to put both of the connectors 66 and 67 facing in the same direction (upward in this case), and thereafter the opposing pin terminals (not shown) are inserted into the insertion holes 74 of the respective connectors 66, 67 to be thereby connected.

If the pressure-welded harnesses 70 to 72 in FIGS. 9 to 11 are so arranged as to face in the same direction as the connectors 66, 67 in FIG. 14, the wires have to be twisted, thereby deteriorating the productivity thereof, quality of the product and so on. In order to avoid this phenomenon, after fitting the wires 61 into the connector 66 at one longitudinal end thereof, the harness has to be inverted to be connected to the other connector 67 at the other end, which consumes a lot of time and labor.

SUMMARY OF THE INVENTION

The present invention has been made to solve the above-mentioned problems, and accordingly, it is an object of the present invention to provide an apparatus and a method for manufacturing electrical harnesses which is capable of readily forming 1—1 harnesses by pressure welding a plurality of wires into an upwardly-facing connector at one longitudinal end thereof and a downwardly-facing connector at the other, and also capable of forming 1-N harnesses by pressure welding the wires into upwardly-facing connectors each at respective ends.

In order to attain the above objective, an apparatus for manufacturing electrical harnesses including wires and electrical connectors according to the present invention is constructed such that it includes a pair of wire measuring rollers. A pair of connector tables are located at a first and a second locations respectively for setting connectors thereon. The first location is near the rollers and the second location is in the wire feeding direction away from the first location. A wire feeding head, disposed near a first connector table, is located at the first location and axially movable between the first and second locations. A vertically movable wire pressing blade is disposed on the first connector table. A second connector table, on which a downwardly-facing connector is set, and a third connector table, on which an upwardly-facing connector is set, can be replaced with each other at the second location.

In the above-described construction, the second connector table further includes a connector receiving groove for receiving the upwardly-facing connector, and a pectinate wire guide section (i.e., a wire guide section with toothlike projections like those of a comb) having a plurality of slits in the connector receiving groove. The second connector table is urged upwardly by an urging means. A wire pressing blade is disposed under the second connector table to be inserted into the slits, while a pressing member against the downwardly-facing connector is also disposed above the second connector in a vertically movable manner. A vertically movable harness pushing-up means is disposed in the nearby area thereof.

Furthermore, it can be constructed such that the third connector table includes a wire pressing blade disposed thereabove in a vertically movable manner. The second and third connector tables are supported by a block, respectively wherein each block includes an insertion notch hole for receiving a bolt which is spirally inserted into an axial shifting means mounted on a frame base.

Still further, in the above construction, the wire measuring rollers, the connector tables and the wire pressing blades are all arranged as shiftable in the direction intersecting with the wires.

On the other hand, a method of manufacturing pressure-welded harnesses according to the present invention for pressure welding electrical wires into connectors set on a pair of first and second connector tables, respectively, the steps of : setting an upwardly-facing connector on the first connector table; setting a downwardly-facing connector on the second connector table; inserting the electrical wires into the downwardly-facing connector, pressing the downwardly-facing connector toward a pressing blade disposed under the wires for pressure welding the wires into the downwardly-facing connector, characterized in that the second connector table can be replaced with a third connector table for setting a downwardly-facing connector thereon.

In an operation for manufacturing the pressure welding harness, a wire feeding head sends a plurality of wires either to a second connector table having a downwardly-facing connector or to a third connector table having an upwardly-facing connector set thereon. In the case where the wires are sent to the second connector table, the wires are then inserted into slits formed in a wire guide section on the second connector table. Thereafter, the wires are pressed to either the downwardly-facing connector on the second connector table or to the upwardly-facing connector on the third connector table by a pressing member and a pressing blade, respectively wherein the downwardly-facing connector is pressed downward against an urging force of a spring so that the pressing blade disposed thereunder presses the wires through the slits. Then, the third or the second table is laterally shifted together with the respective block, so that only the connector is left, whereby the wires are extended or shortened by the measuring rollers and the wires are welded also into an upwardly-facing connector on the first connector table by a pressing blade disposed thereabove.

Other features and advantages of the invention will be apparent from the following description taken in connection with the accompanying drawing.

DETAILED DESCRIPTION OF THE PREFERRED EMBODIMENTS

Figures 1A, 1B:
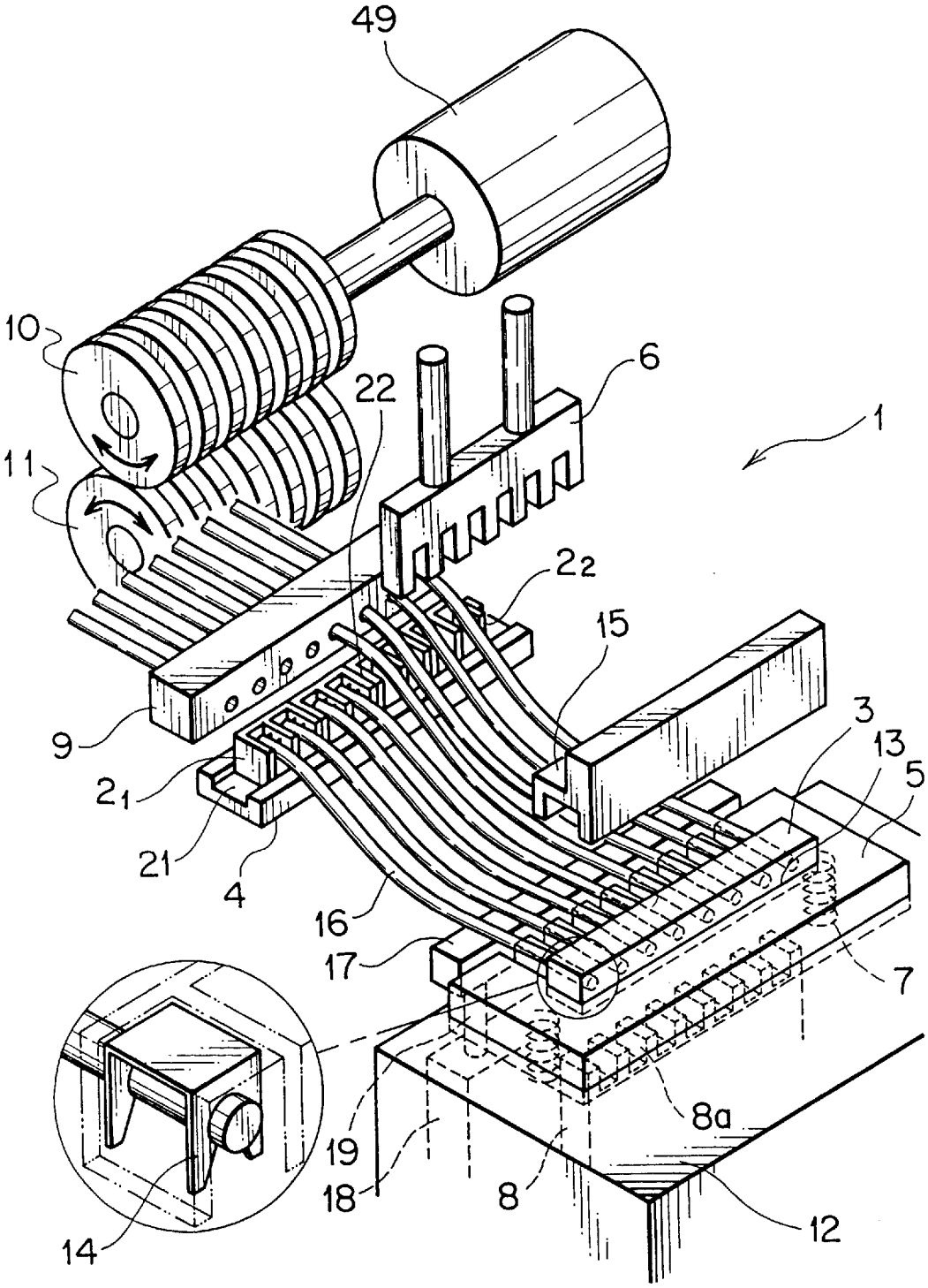
FIG. 1 is a perspective view generally showing an apparatus for manufacturing pressure welded harnesses and a method thereof according to the present invention.
Figure 2:
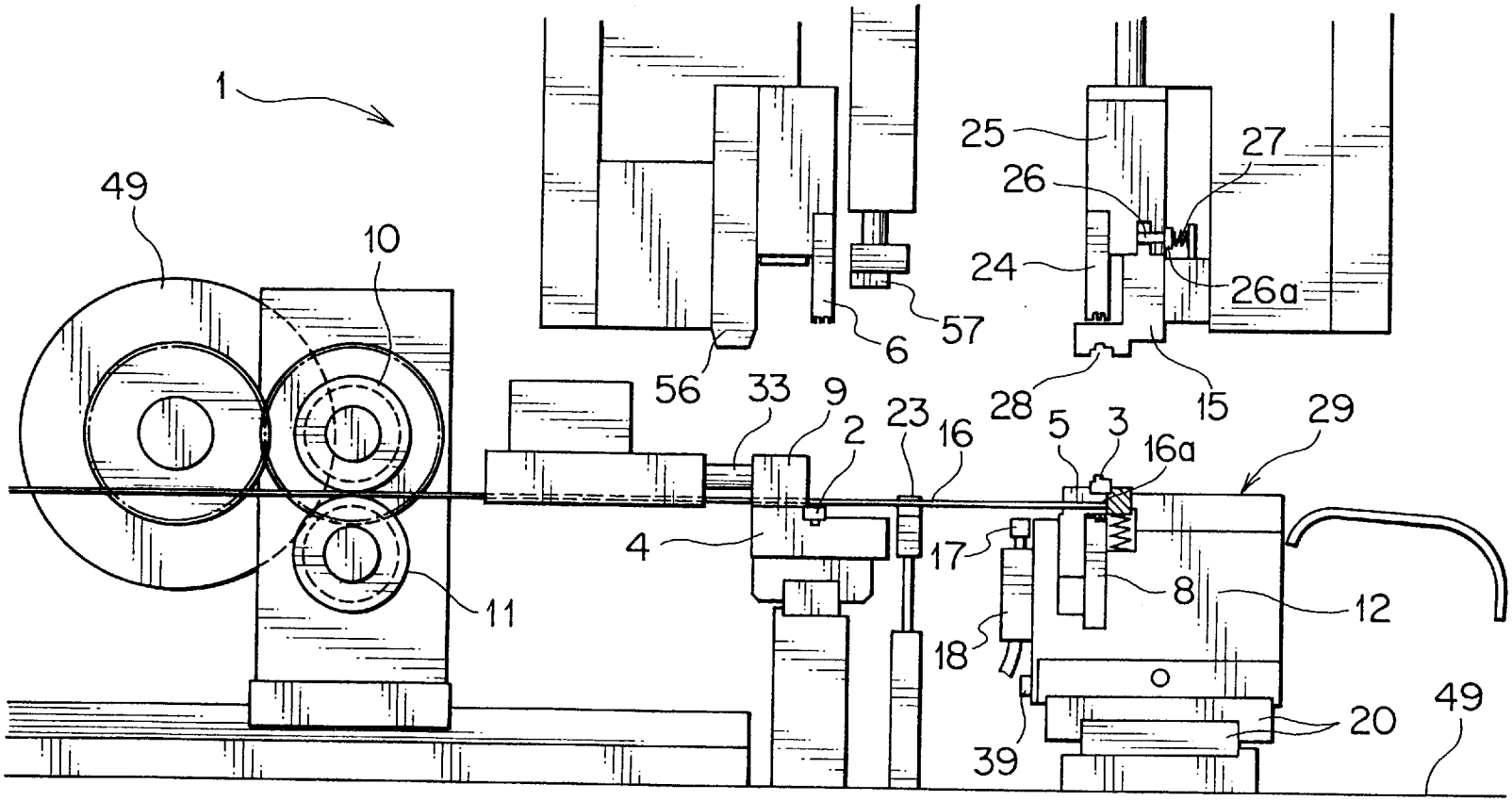
FIG. 2 is a side view showing a detailed embodiment of the above apparatus for manufacturing pressure welded harnesses.

FIG. 1 is a perspective view generally showing an apparatus for manufacturing pressure welded harnesses and a method thereof according to the present invention, while FIG. 2 is a side view showing a detailed embodiment of the apparatus in FIG. 1.

The pressure welded harness manufacturing apparatus 1 includes: a first connector table 4 (hereinafter referred to just as "a table 4") to which a plurality of short connectors $\mathbf{2}_1$, $\mathbf{2}_2$ can be set in an upwardly-facing mode; a second connector table 5 (or just "a table 5") to which a long connector 3 can be set in a downwardly-facing mode; a first pressing blade 6 disposed above the first table 4; a second pressing blade 8 disposed under the second table 5 which is urged upwardly by a spring 7; a wire feeding head 9 capable of shifting in the axial direction between the tables 4 and 5; and a pair of wire measuring rollers 10 and 11 disposed behind the first table 4 (opposite to the wire feeding direction). The second table 5 is replaceable with a third table to be described further below.

The first pressing blade 6 and the wire measuring rollers 10, 11 can be laterally shifted to intersect with the tables 4 and 5, wherein the rollers 10, 11 are vertically movable in the direction moving away from each other. The structure including the first table and the measuring rollers are already disclosed in Japanese Application No. Heisei 7-15744. The second table 5 can be shifted downwardly against an urging force of the spring 7, and the second pressing blade 8 of a pectinate shape (i.e., having toothlike projections similar to those of a comb); is fixed within a block 12 supporting the second table 5. This second table 5 is provided with a plurality of openings (not shown) for receiving the teeth section 8*a* of the second pressing blade 8.

On the second table 5, the long connector 3 is disposed in a downwardly-facing mode. In other words, with the pressure welding terminals 14 thereof facing downwardly, and disposed above the downwardly-facing connector 3 is a connector pressing member 15. In the present embodiment, one long connector 3 is set in the receiving groove 13, and the connector 3 is pressed by the pressing member 15, so that a plurality of wires 16 are pressure welded into the terminals 14 of the connector 3 by the second pressing blade 8. The long connector 3 can be replaced with a plurality of downwardly-facing short connectors on the second table 5.

Between the two tables 4 and 5, a side shaft 17 or a side plate (not shown) disposed behind the second table for pushing up the harnesses is connected to a rod 19 of a vertical cylinder 18, which side shaft 17 and the cylinder 18 form a harness upwardly-pushing means. The side shaft 17 is provided for removing the downwardly-facing connector 3 from the receiving groove 13 of the second table 5. The second table 5 is laterally shiftable together with the block 12 in the intersecting direction with the wires 16 due to the function of a servo-motor as a lateral shifting means (not shown) and also of an LM guide 20 (shown in FIG. 2). After pushing up the downwardly-facing connector 3 to which the wires 16 are pressure welded, the second table 5 is shifted away together with the connector 3 in the lateral direction, so that the wires 16 are extended forwardly or drawn rearwardly by the measuring rollers 10, 11 (at this moment, the wires 16 are not pressure welded yet to the short connectors $\mathbf{2}_1$, $\mathbf{2}_2$ on the first table 4). The extending or drawing operation is performed by rotating a roller activating motor 49 either in the clockwise or counter-clockwise direction.

In this embodiment, two short connectors $2_1$, $2_2$ are serially set in the connector receiving groove 21 of the first table 4. In this state, after pressure welding the wires 16 to the connector $2^1$, the first blade 6 and the measuring rollers 10, 11 are laterally shifted in the same direction, and after extending or drawing the wires 16 corresponding to the other short connector $2_2$ by the measuring rollers (state as shown in FIG. 1), the wires 16 are pressure welded to the connector $2_2$ by the blade 6. The wires 16 are severed by a mutual sliding movement between the blade 6 and the wire feeding head 9. The wire feeding head 9 is shiftable in the forward or rearward direction passing through a space between the upper measuring roller 10 and the lower measuring roller 11. It is to be noted that by the lateral shifting movement of the first table 4, the wires 16 can be connected in a cross-like form and also a joint portion 22 between the two connectors $2_1$ and $2_2$ can be intentionally shifted. In FIG. 2, a pectinate wire guide 23 is disposed in the forward (wire feeding) direction of the second connector table 4 in a vertically movable manner. The pressing member 15 above the second table 5 is removably set at the lower end portion of a ram 25 for raising and/or lowering a third pressing blade 24 by a fixing pin 26. The fixing pin 26 is urged toward the inserting direction thereof by a spring 27, and is easily removed by drawing the pin head 26*a* against the urging force of the spring 27. The pressing member 15 is provided with a fitting groove 28 for receiving the downwardly-facing connector 3.

Figure 3:
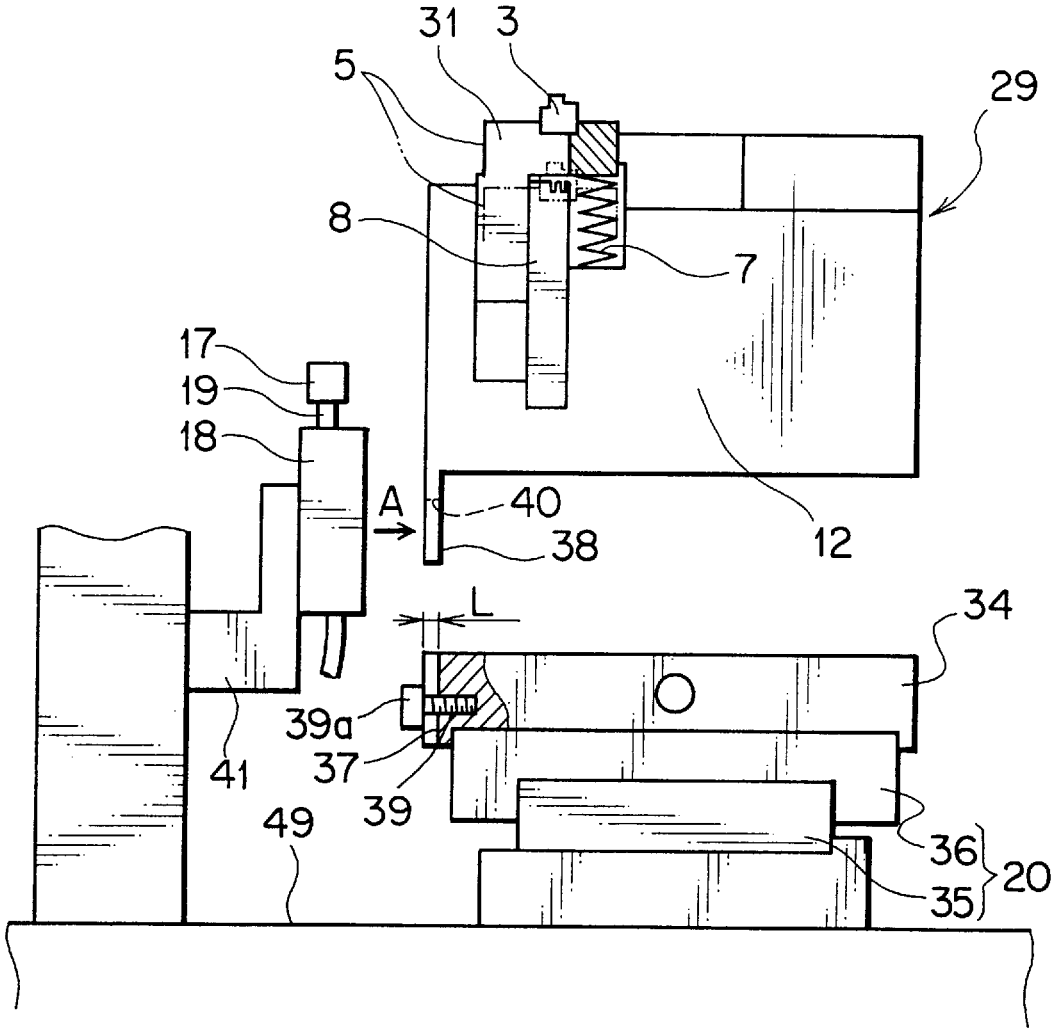
FIG. 3 is a longitudinal cross-sectional view of a 1 —1 type harness manufacturing apparatus.
Figure 4:
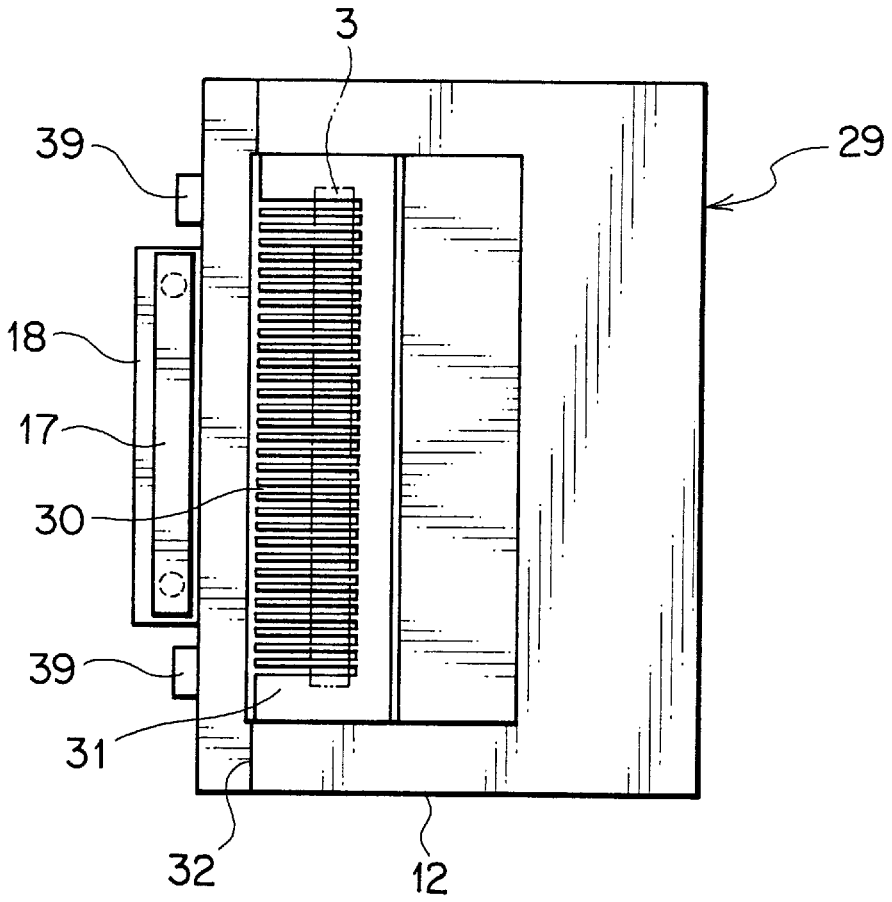
FIG. 4 is a plan view of the apparatus of FIG. 3.

The connector 3 pressed by the pressing member 15 sinks into the block 12 together with the second table 5, whereby the wires 16 are pressure welded by the second blade 8 (refer to the chained lines in FIG. 3). The second table 5 and the block 12 together jig a jig 29 for 1—1 harnesses. As shown in FIGS. 3 and 4, the second table 5 is formed with a pectinate wire guide section 31 having a plurality of slits 30 for receiving the front end portions 16a of the wires 16. The bottom portions of the slits 30 are formed with a plurality of openings through which the teeth portion 8*a* of the second blade 8 can be inserted. The wire feeding head 9 (FIG. 2) abuts against a stopper 32 formed at a side portion of the wire guide section 31 (FIG. 4), slides along the guide bar 33 (FIG. 2) with a spring (not shown) being shrunk, and then pushes the wire front end portions 16a so that they protrude into the slits 30 of the wire guide section 31. The second table 5 can be pushed into the block 12 against an urging force of the spring 7 which, as a matter of fact, can be replaced by another urging means.

The block 12 is removably set on a slide base 34 on the LM guide 20 provided on a frame base 49 as shown in FIG. 3. The LM guide 20 is composed of a rail 35 and a slider 36, and the slide base 34 is fixed onto the slider 36 by a bolt. At one end of the slide base 34 (opposite side to the wire feeding direction) , a guide groove 37 is formed in the vertical direction for receiving a fixing plate 38 hanging downwarly from one end of the block 12.

Figure 5:
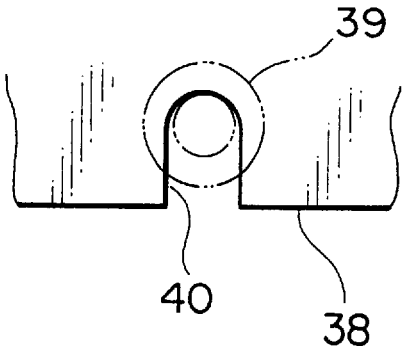
FIG. 5 is a front view of a fixing section of the manufacturing jig.

Two bolts 39 are spirally inserted into the guide groove 37 in the horizontal direction, and the fixing plate 38 of the block 12 is formed with notched holes 40 as shown in FIG. 5 for receiving the head portions 39*a* of the bolts 39, wherein the notched holes 40 are fitted with the bolts 39, leaving the head portions 39*a* thereof slightly protruded for more than the depth L of the guide groove 37. The vertical cylinder 18 for pushing up the wires is situated at the upper diagonal direction of the slide base 34, and is fixed on a stay 41 mounted on the frame base 49.

Figure 6:
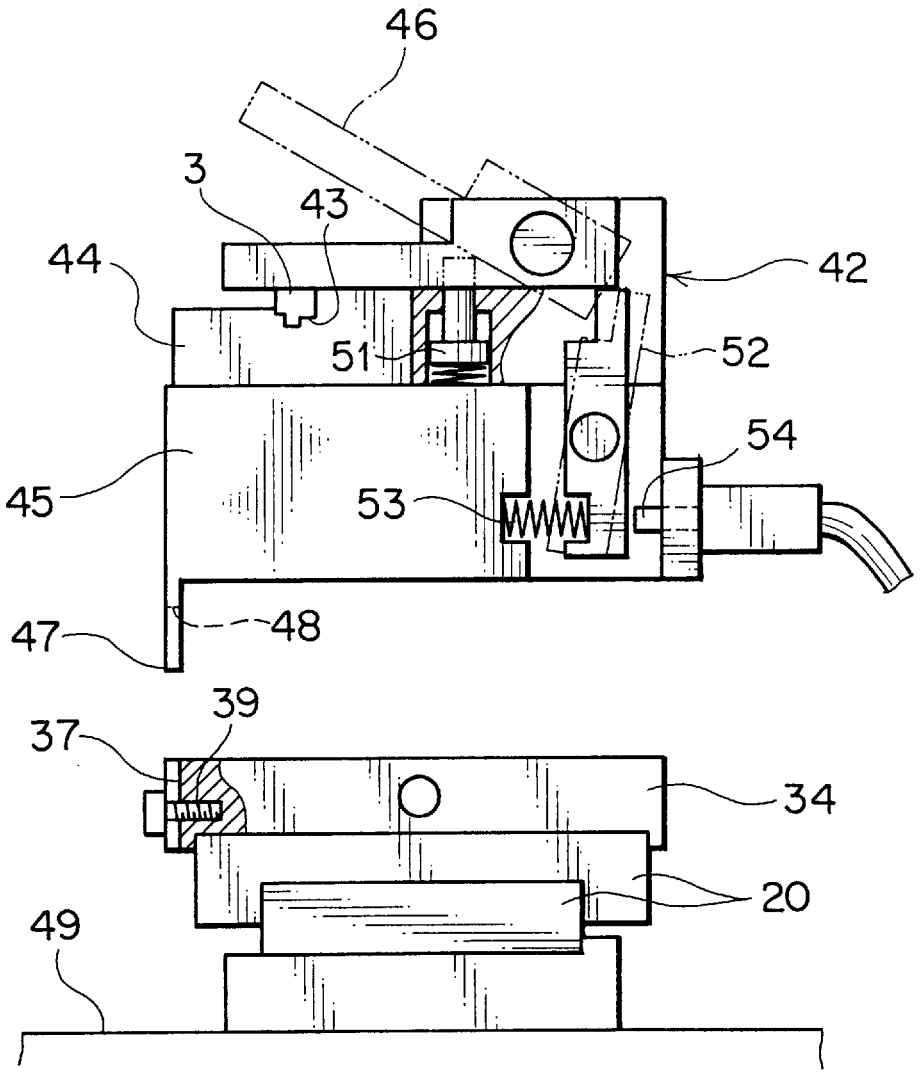
FIG. 6 is a longitudinal cross-sectional view of a 1-N harness manufacturing apparatus.

The above-described 1—1 harness jig 29 can be readily replaced by a 1-N harness jig 42, as shown in FIG. 6, only by unscrewing the bolt 39 to remove the fixing plate 38, and then inserting a fixing plate 48 of the jig 42. The jig 42 comprises a third table 44 to which a long connector 3 can be set in a upwardly-facing mode, a block 45 to which the third table 44 is fixed, and a pectinate guide lid 46 which can be opened and/or closed on the third table 44. This 1-N type harness jig 42 is also disclosed already in the before-mentioned Japanese Application No. Heisei 7-15744.

Figure 7:
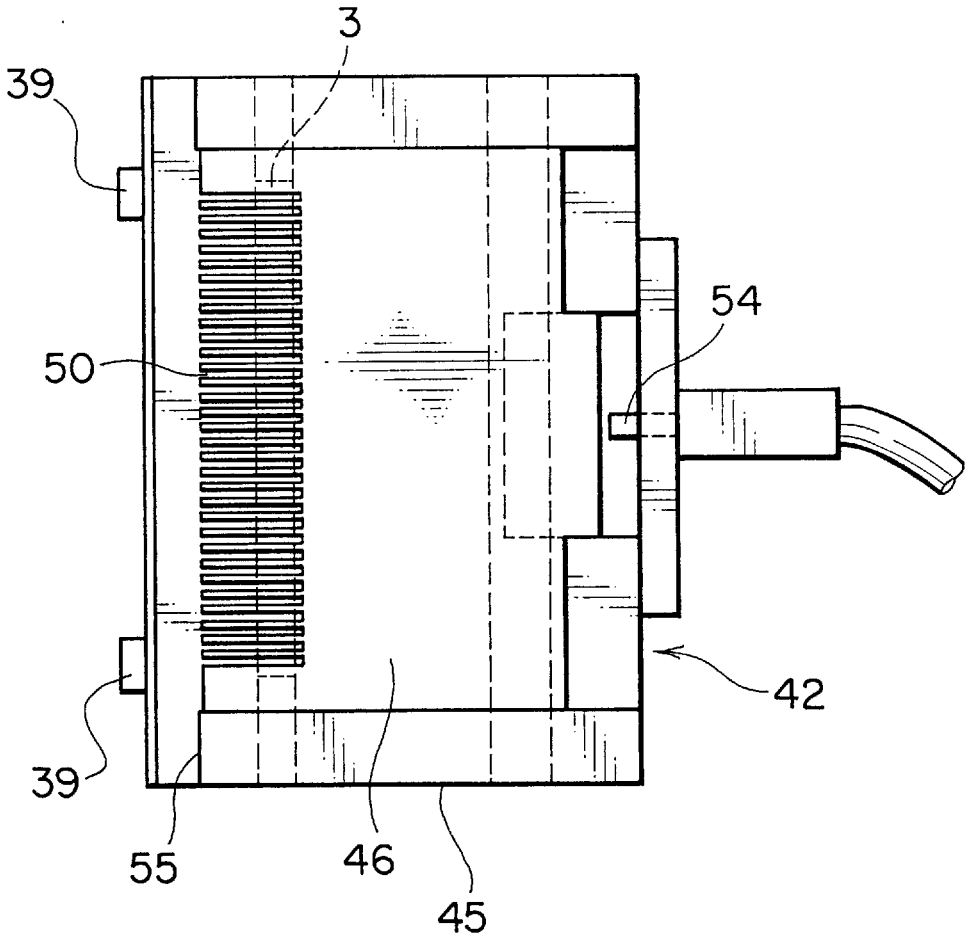
FIG. 7 is a plan view of the apparatus of FIG. 6.
Figure 8:
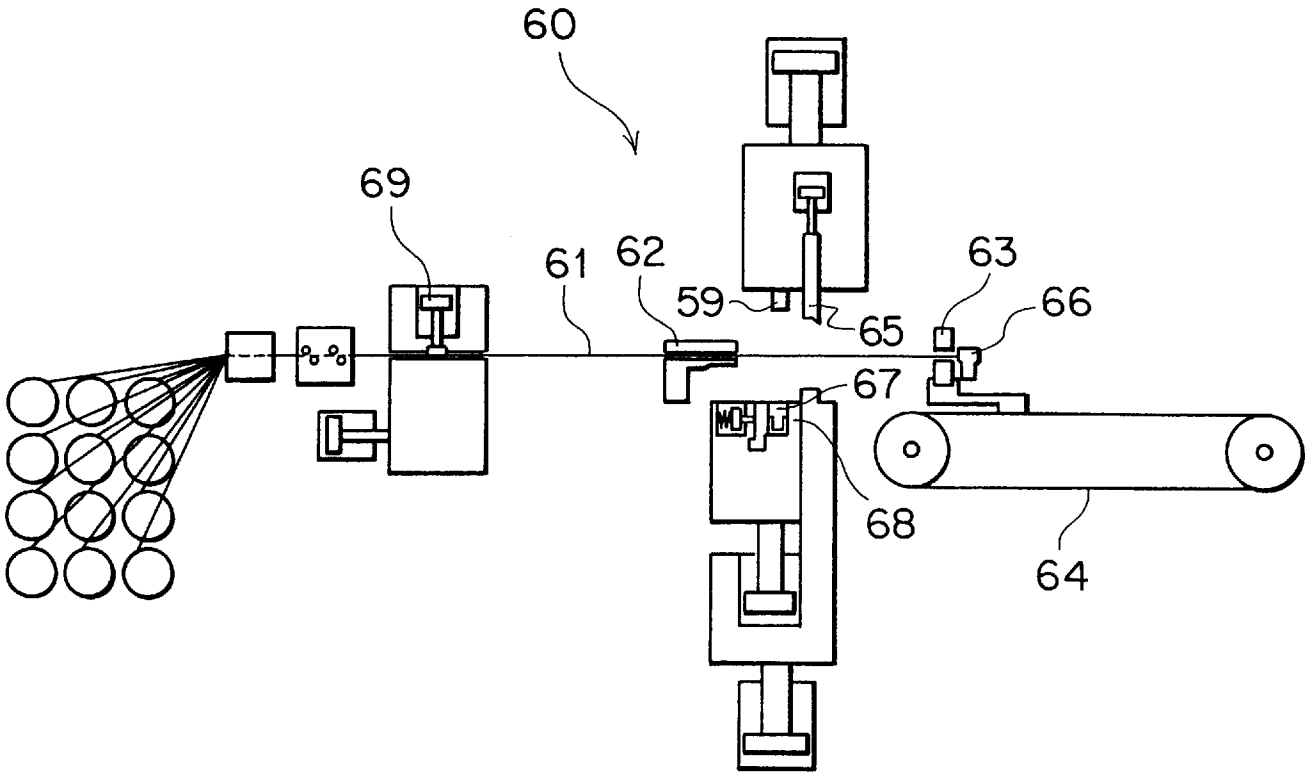
FIG. 8 PRIOR ART
FIG. 8 is a side view of a prior art apparatus for manufacturing pressure-welded harnesses.
Figure 9:
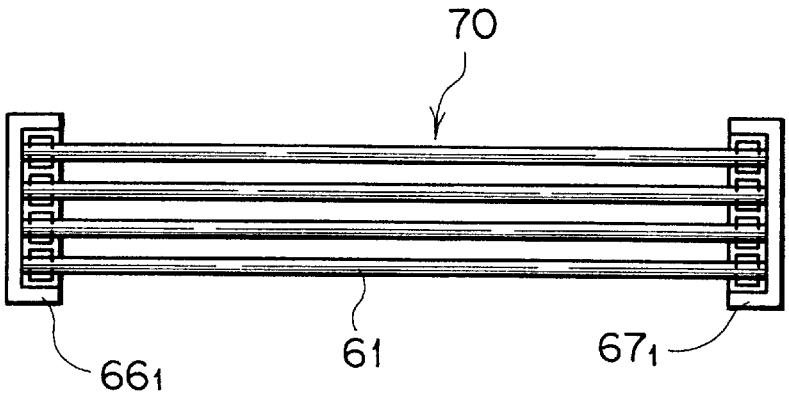
FIG. 9 PRIOR ART
FIG. 9 is a plan view of a prior art pressure-welded harness.
Figure 10:
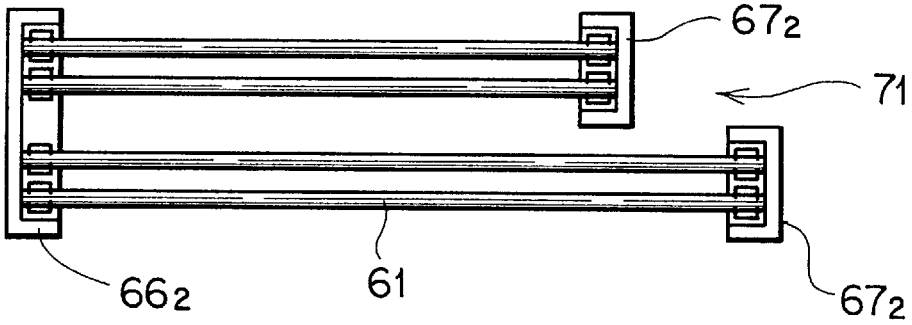
FIG. 10 is a plan view of a 1-2 type pressure-welded harness.
Figure 11:
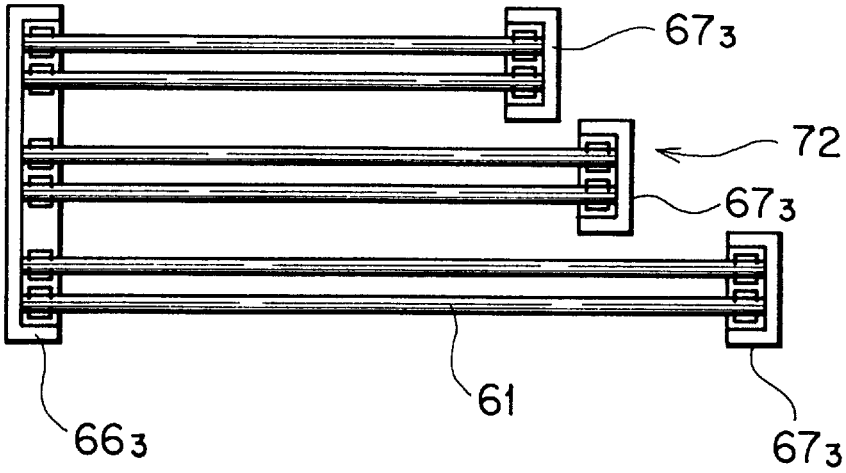
FIG. 11 is a plan view of a 1–3 type pressure-welded harness.
Figure 12:
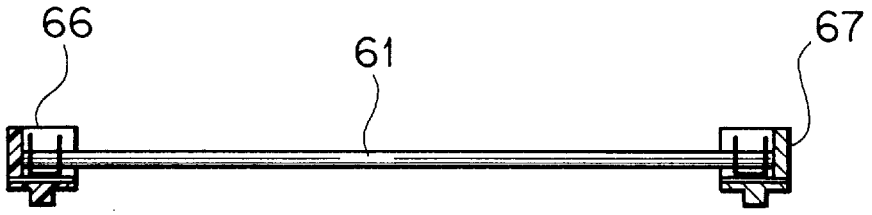
FIG. 12 is a longitudinal cross-sectional view of a 1-N harness.
Figure 13:
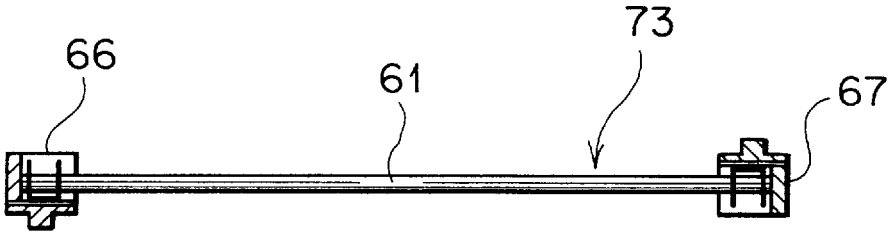
FIG. 13 is a longitudinal cross-sectional view of a 1—1 harness.
Figure 14:
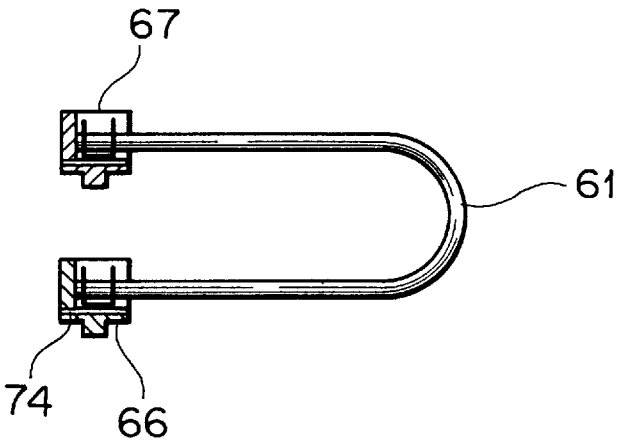
FIG. 14 is a longitudinal cross-sectional view of a 1—1 harness being bent for use.

The block 45 of the 1-N harness jig 42 comprises a downwardly protruded fixing plate 47, so that it can be easily fixed by fitting the notched holes 48 of the fixing plate 47 (same shape of FIG. 5) with the bolts 39 of the slide base 34 and fastening the bolts. The pectinate guide lid 46 is, as shown in FIG. 7, formed with a plurality of slits 50 for receiving the wire end portions at the end portions thereof, and is urged to be open. The guide lid 46 is locked by a locking link 52 at its closed state, and it is released by pushing the link 52 by the cylinder pin 54 against an urging force of the spring 53.

The wire feeding head 9 abuts against a stopper 55 at the block side (FIG. 7) and sets the wire front end portions 16*a*, inserted into a plurality of slits 50, into the slits 50 so that the third blade 24 can also be inserted. When using the 1-N harness jig 42, the pressing member 15 used for a downwardly-facing connector has to be removed beforehand. In FIG. 2, reference numeral 56 denotes a pressing guide which is vertically movable together with the first pressing blade 6, while numeral 57 denotes a wire suppressor. The second table 5 and the third table 44 can be replaced with various tables depending on the size, shape or the like of the connector 3.

[Effect of the Invention]

As explained heretofore, according to an apparatus for manufacturing pressure welded harnesses, 1—1 harnesses and 1-N harnesses can be easily manufactured using the same apparatus, but only by replacing the second table with the third table to replace a downwardly-facing connector with an upwardly-facing connector, while keeping an upwardly-facing connector on the first table. Further, various types of pressure welded harnessers can be obtained by laterally shifting the connector tables, wire pressing blades, wire measuring rollers and so on.

While the invention has been described with reference to specific embodiments, the description is illustrative and is not to be construed as limiting the scope of the invention. Various modifications and changes may occur to those skilled in the art without departing from the spirit and scope of the invention as defined by the appended claims.

What is claimed is:

1. An apparatus for manufacturing pressure-welded electrical harnesses including wires and electrical connectors, said apparatus comprising; a pair of wire measuring rollers, a pair of connector tables located respectively at a first and a second locations for setting connectors thereon, said first location being near said rollers and said second location being in the wire feeding direction away from said first location, a wire feeding head disposed near a first connector table located at said first location and axially movable between said first and second locations, and a vertically movable wire pressing blade disposed on said first connector table, characterized in that said second connector table further comprises a connector receiving groove for receiving said downwardly-facing connector, and a pectinate wire guide section having a plurality of slits in said connector receiving groove, said second connector table being urged upwardly by an urging means, wherein a wire pressing blade insertable into said slits is disposed under said second connector table, and a pressing member against said downfacing connector is also disposed above said second connector in a vertically movable manner.

2. The apparatus for manufacturing pressure-welded electrical harnesses as claimed in claim 1, further comprising a third connector table and means for alternatively replacing said second connector table, on which said downwardly-facing connector is set, and said third connector table, on which an upwardly-facing connector is set, with each other at said second location, wherein said third connector table further comprises a wire pressing blade disposed thereabove in a vertically movable manner.

3. The apparatus for manufacturing pressure-welded electrical harnesses as claimed in claim 2, wherein said second and third connector tables are supported respectively by a block, such that said block supporting said second connector table and said block supporting said third connector table each comprise an insertion notch hole receiving a bolt which is spirally inserted into an axial shifting means mounted on a frame base.

4. The apparatus for manufacturing pressure-welded electrical harnesses as claimed in claim 3, wherein said wire measuring rollers, said connector tables and said wire pressing blades are all shiftable in a direction intersecting with wires.

5. The apparatus for manufacturing pressure-welded electrical harnesses as claimed in claim 1 or 2, wherein said wire measuring rollers, said connector tables and said wire pressing blades are all shiftable in a direction intersecting with wires.

6. A method of manufacturing pressure-welded electrical harnesses, whereby electrical wires are pressure welded into connectors set on a pair of first and second connector tables, said method comprising the steps of: setting an upwardly-facing connector on said first connector table;

setting a downwardly-facing connector on said second connector table;

disposing said electrical wires, fed from a wire feeding head, under said downwardly-facing connector on said second connector table: and pressing said downwardly-facing connector set on said second connector table, urged upwardly by springs, toward a pressing blade by means of a connector pressing member to pressure weld said wires into said downwardly-facing connector.

7. The method of manufacturing pressure-welded harnesses as claimed in claim 6, wherein said step of setting said downwardly-facing connector on said second connector table further comprises replacing said second connector table with a third connector table for setting an upwardly-facing connector thereon.

8. The apparatus for manufacturing pressure-welded electrical harnesses as claimed in claim 1 or 2, wherein a vertically movable harness upwardly-pushing means is disposed in an area nearby said second connector table.

9. The apparatus for manufacturing pressure-welded electrical harnesses as claimed in claim 8, wherein said second and third connector tables are supported respectively by a block, wherein said block supporting said second connector table and said block supporting said third connector table each comprise an insertion notch hole for receiving a bolt which is spirally inserted into an axial shifting means mounted on a frame base.

10. The apparatus for manufacturing pressure-welded electrical harnesses as claimed in claim 8, wherein said wire measuring rollers, said connector tables and said wire pressing blades are all shiftable in a direction intersecting with wires.

* * * * *